United States Patent [19]

Kramer et al.

[11] 4,033,012

[45] July 5, 1977

[54] BUTTON, PARTICULARLY FOR CLOTHING PIECES

[75] Inventors: Friedhelm Kramer, Ennepetal-Milspe; Günter Wolfertz, Wuppertal-Barmen; Harald Klaus, Wuppertal-Elberfeld; Raimund Stanik, Wuppertal-Beyenburg; Horst Gustav Appelt, Wuppertal-Barmen; Walter Ramspott, Wuppertal-Cronenberg, all of Germany

[73] Assignee: Schaeffer-Homberg GmbH, Wuppertal-Barmen, Germany

[22] Filed: Oct. 29, 1975

[21] Appl. No.: 626,987

[30] Foreign Application Priority Data

| | | |
|---|---|---|
| Nov. 14, 1974 | Germany | 7438001 [U] |
| Jan. 30, 1975 | Germany | 2503798 |
| Feb. 7, 1975 | Germany | 2505139 |
| July 16, 1975 | Germany | 2531728 |

[52] U.S. Cl. ..... 24/90 D; 24/95; 24/96

[51] Int. Cl.[2] ..... A44B 1/42

[58] Field of Search ..... 24/94, 95, 96, 90 D, 24/227

[56] References Cited

UNITED STATES PATENTS

| | | | |
|---|---|---|---|
| 496,357 | 4/1893 | Hall | 24/95 |
| 688,278 | 12/1901 | Adams | 24/95 |
| 1,359,038 | 11/1920 | Beaumont | 24/90 D |
| 2,928,153 | 3/1960 | Reiter | 24/95 |

FOREIGN PATENTS OR APPLICATIONS

| | | | |
|---|---|---|---|
| 284,866 | 12/1952 | Switzerland | 24/96 |

*Primary Examiner*—Paul R. Gilliam
*Assistant Examiner*—Kenneth J. Dorner
*Attorney, Agent, or Firm*—Martin A. Farber

[57] ABSTRACT

A button, particularly for clothing pieces, comprising a foot part secured on a clothing piece with clamping of the carrier material, and a button plate freely tiltably seated on the foot part. The foot part includes a head end which is formed with an insert opening freely tiltably receiving therein a tilting pin connected to the button plate.

8 Claims, 25 Drawing Figures

FIG. 6
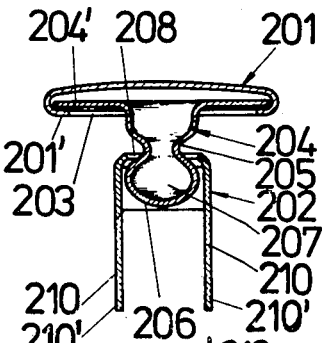
FIG. 8
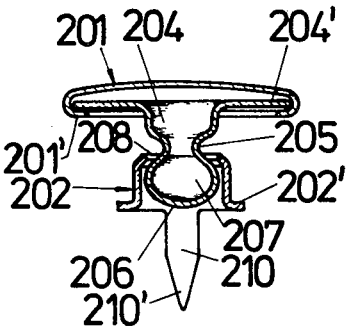
FIG. 7
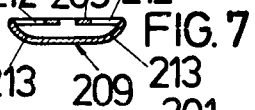
FIG. 9
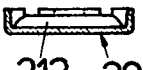
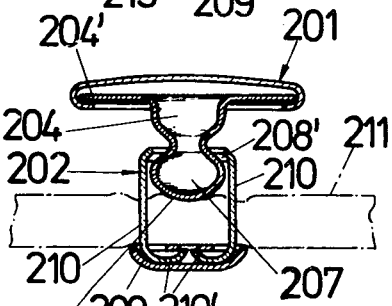
FIG. 10
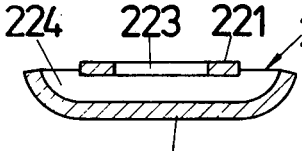
FIG. 11
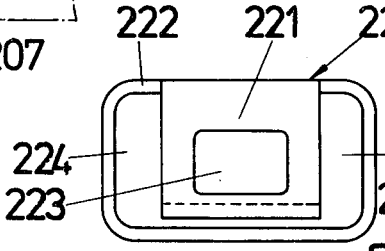
FIG. 12
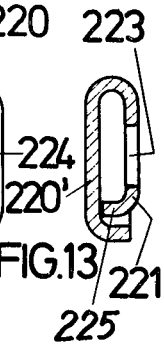
FIG. 13

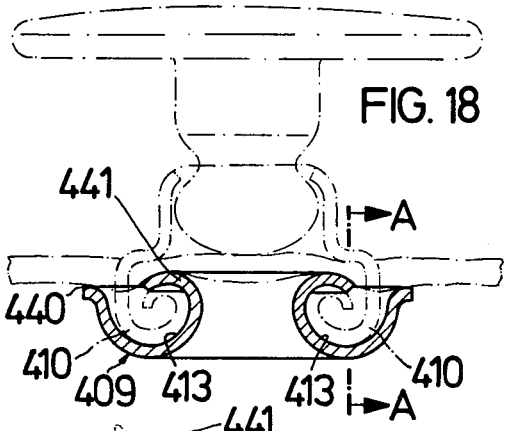
FIG. 18
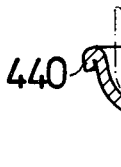
FIG. 19
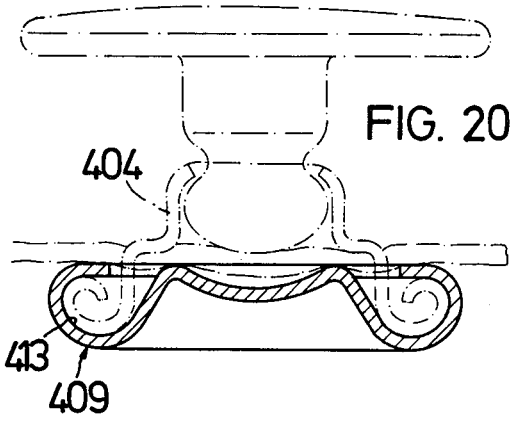
FIG. 20
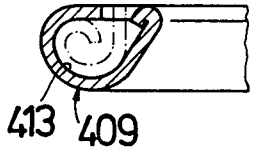
FIG. 21
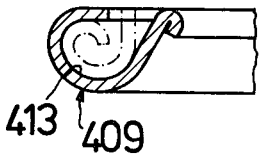
FIG. 22
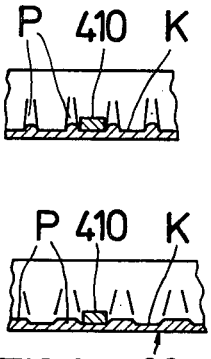
FIG. 23
FIG. 24
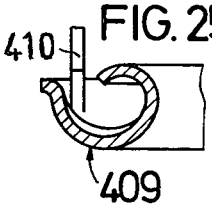
FIG. 25
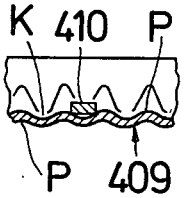
FIG. 26

BUTTON, PARTICULARLY FOR CLOTHING PIECES

The invention relates to a button, particularly for clothing pieces, with a foot part secured on the clothing piece by means of a concealed plate with clamping of the carrier material, and a freely tilting button plate seated on the foot part.

The sense and purpose of such designs are to maintain, also with such button constructions which itself have a rigid stay, the pivotablity of the button plate which is obtainable with sewing webs or thread stems.

A form of construction is known by which the material of the clothing piece is clamped between two hollow rivets passing through each other, which rivets extend as a stay in the pot-like constructed button body and here are widened at the end side by riveting, so that the button body is held, sitting thereon with play. The riveting is done from the button side. In order to avoid the coarsest disfiguration a steel plate having a conical projection is incorporated for aiding the riveting. This all leads however to a considerable manufacturing expense, particularly to a large number of construction parts.

Accordingly it is an object of the present invention to construct a button of the introductory-mentioned type in simple manner, advantageously coordinated with the smallest number of individual construction parts, in stable manner, such that the anchoring of the construction parts relative to each other may take place without impairment of the latter.

In accordance with another object of the invention, the above-mentioned object is solved in that the foot part has an insert opening for the tilting pin on the head end of the foot part.

In this manner it is advantageous in accordance with the invention to construct the head surface-annular edge of the foot part adjacent the insert opening as an assembling tool-support surface, the latter coursing spaced apart relative to the lower side of the button plate.

Furthermore it is advantageous in accordance with the invention that the pot-shaped formed foot part has per se known folded back securing claws which are substantially flush with the pot wall.

Then it is favorable in accordance with the invention, when the tilting pin is hollow rivet-like widened on its free end in the inner cavity of the foot part.

The present invention further proposes to provide the tilting pin with a pivot channel in the range of the edge of the insert opening.

Also according to the present invention there resides an advantageous construction with the tilting pin having on its free end a ball head which snaps-in the insert opening of the foot part.

Further it is of advantage according to the invention to provide an elastic cross-sectionally enlargeable tilting pin, which widens in a direction toward the free end, and carries a expander body in an axial hollow.

In this manner it is favorable in accordance with the invention when a stick-through insertion opening is provided flush to this axial hollow.

As a result of such construction a button is produced in accordance with the invention of increased serviceability. The tilting pin forming the stay of the button originates from the button plate. The free end serving for its anchoring with the foot part is disposed now in an insert opening of this foot part. If a riveting is preferred, then the rivet position is shifted from the range of the button in the foot part. Moreover the latter is covered by the thereover lying button plate in an aesthetically optically pleasing manner. Here the annular edge of the head surface adjacent to the insert opening, is used in an advantageous way as a support surface for an assembling tool, the support surface being spaced from the lower side of the button plate. The counter tool is fed under the foot part. Thereby assembling tracks, for example, in the form of the pressure marks inpairing mostly the appearance of such buttons are most extensively avoided and withdrawn from direct view, respectively, by the present invention. The pot-shape of the foot part contributes in a favorable manner to the optimization of the tiltability and pivotability, respectively, of the button plate. The insert opening lying in the pot-bottom displaces the tilting zone further upwardly; moreover it permits the pot-cavity to be most favorably used for an increased free movement of the rivet-head-like anchoring end. The fastening base extending directly under the foot part is not impaired. With a continuous cross-sectionally uniform tilting pin thickness which extends through the insert opening, the stay can penetrate sufficiently deep in the foot part, so that the stay first can be telescopically pulled outwardly when corresponding forces act on it. If such a penetration of the tilting pin in the pot-shaped foot part is not intended, then the tilting pin can be provided with a pivot channel in the range of the insert opening edge, which holds the axial displacement of the tilting pin within limits. A toolless assembling of the button may be realized in such manner where the tilting pin has on its free end a ball head which snaps into the insert opening of the foot part. The tilting pin and the mouth of the insert opening are adjusted and correlated to the tiltability of the button plate. A likewise favorable construction form adjusted with respect to a toolless assembling resides in that the tilting pin which is cross-sectionally enlargeable at least on its insert-sided end, widens toward the free end and carries an expander body in an axial hollow. The latter can here be a spherical body, which can be easily brought in from the bottom of the foot part. If a stick-through opening connects above this in axial flush alignment to the axial hollow of the pin, then the ball which serves as the expander body, can always be pushed out again from the button plate side. The tilting pin may then be drawn out from the insert opening of the foot part. The expander body can again at the time of the separation be inserted into the tilting pin, so that the ball does not get lost. For securing the foot part, securing claws, which are freely cut from its pot edge, can be secured under certain circumstances with clamping of the, for example, textile securing base, between a counter holding plate. On the other hand also the counter holding plate itself can have corresponding claws which then interlock over the pot edge of the foot part.

In order, furthermore, in spite of good moveability to obtain indeed an oscillation-free retention of the button plate, according to a further object and proposal of the invention, the foot part has an insert opening for the tilting pin on the head end of the foot part, the lower front face of which pin rests on the carrier material.

In addition it is advantageous in accordance with the invention to arrange the bent back ends of the per se known securing claws, which originate from the pot wall, under a cap shaped concealed plate, which plate is provided with deflection channels and supports the opposite side of the carrier material.

Then it is advantageous in accordance with the invention that the inner location portion, forming a floor surface facing the carrier material, is made of two stays of the concealed plate which are bent toward each other and has penetration openings for the securing claws.

Further in accordance with another object and proposal of the invention the underside pot edge of the foot part is bent outwardly.

Also an advantageous construction and object of the invention resides in the formation of the tilting pin as a hollow pin with a surface sided annular groove for insertion of the opening edge, which pin with its outwardly directed upper edge zone carries the button plate.

Finally it is advantageous in accordance with the invention that the penetration openings on both sides are formed merely of one stay forming the inner location of the concealed plate, which is bent from one side (cross) edge and is provided with one opening, the free end of which extends into a support leg.

The pot-shape, which is also preserved here, permits in spite of the advantageous moveability of the upper part of the button here an oscillation-free arrangement of the same in which the lower front surface of the tilting pin rests on the carrier material. In this manner there arises a certain clamping of the lower tilting pin end between the interior side of the pot wall adjacent the opening edge thereof and the carrier material. This bracing is yet maintained, by the elasticity and flexibility, respectively, of the carrier material, so lightly that merely the weight of the button is held so that the latter can not tip down or freely oscillate. The movement of the button which is sought for facile service, however, is not diminished in this manner. The lower front surface of the tilting pin can be formed, additionally, in an advantageous manner in a calotte-shape, so that a free moveability of the tilting pin is provided ball-pivot like, with constant engagement on the carrier material. In order to achieve the desired light bracing of the calotte-shaped lower end of the tilting pin with simplest assembling of the button on the carrier material, the bent back ends of known per se securing claws which originate from the pot wall are arranged under a cap shaped concealed plate, the latter being provided with deflection channels and supporting the opposite sides of the carrier material. The deflection channels of this concealed plate thereby provide the advantage that by merely pressing the concealed plate and the pot-shaped foot part together, the mutual securing is attained and beyond this the bent back ends of the securing claws are positioned therein out of view, since the cap or cover surface of the concealed plate can be closed. The floor surface of the concealed plate which faces the carrier material, thereby advantageously merely has penetration openings for the securing claws, so that an advantageous surface support is achieved, which prevents too strong a penetration of the concealed plate into the lower side of the carrier material. Also a penetration of the foot part on the opposite side of the carrier material is most favorably prevented by means of a flange bent underside pot edge of the foot part. With regard to the tilting pin there exists a still favorable embodiment by means of the hollow shape, which with a simplest manner of construction additionally provides a certain elasticity for facilitating its insertion and anchoring in the foot part, whereby a surface sided annular groove, after insertion of the tilting pin in the foot part forms an advantageous support surface in every position of the tilting pin. By bending back of a stay which extends from one of the side edges, the engagement openings for the securing claws are formed in a simple manner by a corresponding two-sided open dimension or region without stamp- or punch-outs, whereby the stay itself indeed can be supported on the cap surface without obstructing the penetration of the claws by means of an end sided bent arm.

Furthermore in order to avoid a bending up of the concealed plate which serves as a counter holding means, for example, by the force effect of the support or carrier material as well as a consequential deformation resulting therefrom of the guide channels for the securing claws, and beyond that to assure that the claws are always perfectly hook-like formed during assembling, according to the invention it is further proposed that the concealed plate is formed as a double location or double layer member, such that the inner location portion is supported against the inner surface of the outer location portion and the inner location is secured against bending up during loading.

In accordance with the invention it is hereby advantageous that the two layers or locations are integrally formed.

Further it is favorable in accordance with the invention that a securing or safety effecting strip projects in an opening of the inner location and grips hook-like behind the support, supporting itself toward or against the inner side of the outer location.

Then it is advantageous according to the invention that the opening of the inner location forms two retainer stays and thus makes possible a hook-shape formation of the securing claws during the fastening or mounting operation.

The invention further provides the proposal that the deflection or guide surfaces and/or the side walls are formed flange-shaped.

Finally it is still of advantage according to the invention that the center section of the outer location has an arch.

The retainer plate forms practically a force-like closed hollow body with radially formed deflection or guide surfaces for the securing claws of the locking element. The materialwise integrally side connected lower part has two retainer stays for the securing claws and a break-through opening, which allows a hook-like formation, that is further curling or rolling-up of the securing claws. The inner location is supported surely on the inner surface of the outer location, such that a deformation of the guide channels for the claws is avoided during assembling and fastening. The safety or securing strip, likewise as the inner location itself, is an integral part of the concealed plate. Due to the channels formed by the radially shaped deflection or guide surfaces, the counter plate acts as the stamp or die of a mounting or assembly tool. For the mounting tool itself, therefore in view of the formation of the surface and of the precision, fewer requirements are set than with a mounting tool which directly forms the claws during the mounting or assembly. It can be carried out cheaper and quicker. The flange shaped formation of the lateral or side side walls of the concealed plate safeguard the carrier material against cutting action and reduces the specific loading on the mounting position. The hidden, covered plate also makes possible a satisfactory visual design of the mounting position; it does not need to be covered.

Also without a double location or layer formation of the concealed plate, in order to be able to stabilize the latter so that deformations are avoided during the application of the securing tool, the invention further provides deflection channels of a circularly shaped concealed plate, the deflection channels having in cross-section a substantially closed annular form, and radially directed stamp-out portions on the deflection or guide surfaces of the deflection channels, the surfaces between the guide surfaces forming guide channels for the securing claws.

Due to this stamping, the surface of the concealed plate which faces outwardly in the direction of the mounting tool is substantially stabilized. Thereby, stampings formed, for example, by displacement of material, nevertheless can be attained, so that the outer surface is maintained completely smooth. On the other hand according to the use of the button a pierced-through stamping can produce a structural or construction form of the outer surface. In addition to the advantage of increased stability, the stampings, which are centered at equal distances radial to the center point, provide that the intermediate spaces between the individual stampings form guide channels for the securing claws. In this manner not only are the securing claws prevented from being uncontrollably displaced, possibly in disturbing position above each other during combination of the construction parts, but but rather a uniform alignment of all securing claws is forced to occur, such that an optimum fastening which is equally stable in all areas is attained between the foot plate and the concealed plate. Due to the guide channels which widen toward the outer periphery of the concealed plate, moreover, a secure insertion of all securing claws is achieved by a certain equalization of spacing tolerances which occur between the individual claws.

With the above and other objects and advantages in view, the invention will become more clearly understood in the following detailed description of preferred embodiments of the invention in connection with the accompanying drawings, in which:

FIG. 6 is a longitudinal cross-sectional view of a fifth embodiment of the button, the button pin of which, which is connected with the foot part, is formed calotte-like;

FIG. 7 is a longitudinal cross-sectional view of a concealed plate in accordance with the invention;

FIG. 8 is a side cross-sectional elevational view of FIG. 6;

FIG. 9 is a cross-sectional elevational view of the concealed plate taken in the same direction;

FIG. 10 is a cross-sectional elevational view of the button of FIG. 6 secured to the concealed plate of FIG. 7 and connected to the carrier material;

FIG. 11 is a cross-sectional elevational view of another embodiment form of the concealed plate;

FIG. 12 is a top plan view of FIG. 11;

FIG. 13 is a lateral central cross-section through FIG. 12;

FIG. 18 is a longitudinal cross-sectional elevational view of another embodiment of a concealed plate in accordance with the invention;

FIG. 19 is a similar view of a variant of FIG. 18 partially broken away;

FIG. 20 is a similar view of a modified embodiment of a concealed plate;

FIG. 21 is a similar view of a variant of FIG. 20 partially broken away;

FIG. 22 is view similar to FIG. 21 showing a modification therefrom;

FIG. 23 is a section taken along the lines A—A of FIG. 18 in development;

FIG. 24 is a view corresponding to that of FIG. 23 illustrating a variant guide channel;

FIG. 25 is a cross-section taken in the range of a guide channel; and

FIG. 26 is a view corresponding to that of FIG. 23 of another embodiment thereof having guide channels which are stamped from the outer side.

Figure 2:
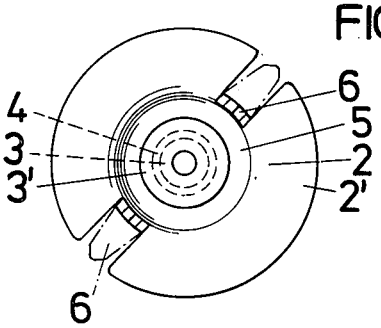
FIG. 2 is a bottom view of the foot part of FIG. 1 and showing the rivet-like widened tilting pin therein.

The button according to a first embodiment form of the invention (FIGS. 1–2) comprises substantially a button plate 1, a foot or base part 2, and a counter punch plate 8 which serves for the fastening on the carrier or textile material 7.

The button plate 1 extends from an upper flat annular surface into a central hollow pin constituting a wobble or tilting pin 3. The latter passes with play through an insert opening 4 of the foot part 2, the latter having a pot-like shape. The play is adjusted according to the degree of tiltability and looseness, respectively, which is desired of the button plate, as well as the height T of the pot-hollow 5 (i.e., the cavity 5 defining the pot-shape).

The free end of the pin 3 is widened by riveting at portion 3', so that the button plate 1 is anchored onto the head end of the foot part 2. The riveting takes place without impairing the button plate 1, during which operation one assembly tool is placed on that annular edge of the head surface of the foot part 2 which is adjacent to the insert opening 4 and constitutes an assembling tool-support surface St, while the other assembly tool is inserted in the easily accessible pot-hollow 5.

For the fastening of the button which is assembled in this manner, pointed securing claws 6 are cut free from the material of the pot edge 2′ and are bent in the direction of a securing base to be clamped, the base being in the form of a carrier material or the like. If this is to have a relatively high rigidity, it suffices to press the securing claws 6 into the position illustrated by the dashed-dotted line; the clamping of the carrier material 7 also can take place still by use of the counter plate 8. The latter has break-through openings 9 in the range of the securing claws 9. The displaced material forming the openings 9 forms a control runner or slide 10 for the securing claws 6, which fold back by pressing the parts 2 and 8 against each other which clamp the carrier material therebetween.

The button plate 1 can be provided with an ornamental cover 11. The latter may be held thereon in the manner of a clip or snap-on connection. Its fitting thereon takes place after conclusion of the riveting, so that the entire distance $x$ between the support surface St for the assembling tool and the lower side 1′ of the button plate is available for use.

Figure 1:
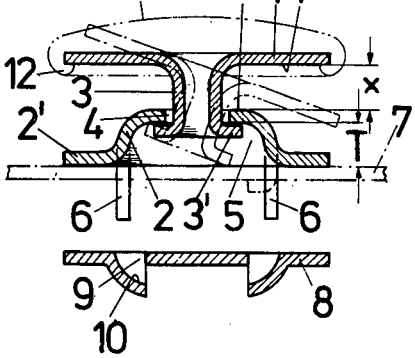
FIG. 1 is a longitudinal cross-sectional view of a button formed in accordance with the invention in unsecured condition, according to a first embodiment.
Figure 3:
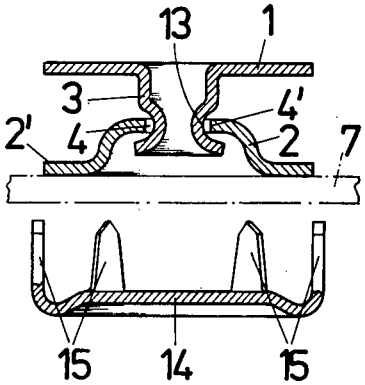
FIG. 3 is a longitudinal cross-sectional view of second embodiment of a button in accordance with the invention in unsecured position with a claw equipped counter retainer plate.

The embodiment of FIG. 3 differs from that of FIG. 1, in so far as that here the wobble pin 3 has a pivot channel 13 in the range of the edge 4′ of the insert opening 4. This channel 13 is developed by a corresponding annular shaped constriction of the here likewise hollow wobble pin 3. This pivot channel limits the axial penetration of the pin 3 into the inner cavity and the pot-hollow 5, respectively, of the foot part 2 by means of a corresponding cross-sectional enlargement of the pin. The end section, which is cross-sectionally reduced for the insertion of the correspondingly set-off pin end, is thereafter again rivet-like widened.

With this embodiment a claw plate 14 is used. Its securing claws 15, which are arranged on its periphery, pass through the carrier material 7 and finally are bent over the pot edge 2′.

Figure 4:
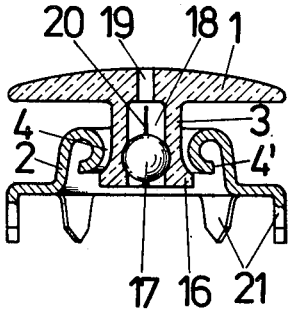
FIG. 4 is a longitudinal sectional view of a third embodiment of a button illustrating a spreader means facilitating a toolless assembling of the button plate and the foot part.

By the embodiment according to FIG. 4, an assembling of the button is made possible without any work tool. The pin 3 of the button plate 1 is here formed as a hollow pin. Its free end is thickened, forming a widened portion 16. By means of a longitudinal slotting, forming slot 20 of the wall of the pin, the cross-section of the pin at that place can be enlarged by insertion of an expander body 17, in the form of a ball, so that also here there is realized an anchoring of the button plate 1 on the foot part 2. The button plate 1 is preferably made of synthetic material. The ball bearing is adjusted complementary to the convex shape of the ball, so that the ball can not slip.

The insert opening 4 is formed by curling or turningover the foot part 2. In this manner the edge 4′ of the rim of the metal foot part, which edge forms a cut, is placed out of contact with the tilting pin, the latter being preferably produced of synthetic material, and thus a substantially therefrom resulting source of wear and tear is avoided. By pushing the expander body 17 out, which is possible by means of a nail, stud or the like. Via a stick-through insert opening 19 aligned with the axle hollow 18, the enlarged end 16 of the pin can step back or return to a position behind (i.e., smaller than) the diameter of the insert opening 4; the button plate 1 is then detachable. By this embodiment the securing claws 21 which clamp the carrier material originate from the edge of the foot part 2.

Figure 5:
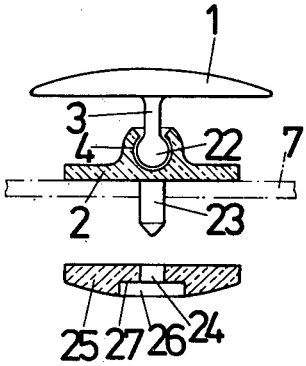
FIG. 5 is a longitudinal view of another embodiment of a button with the foot part and the counter retainer plate in cross-section made preferably of a thermoplastic material.
Figure 14:
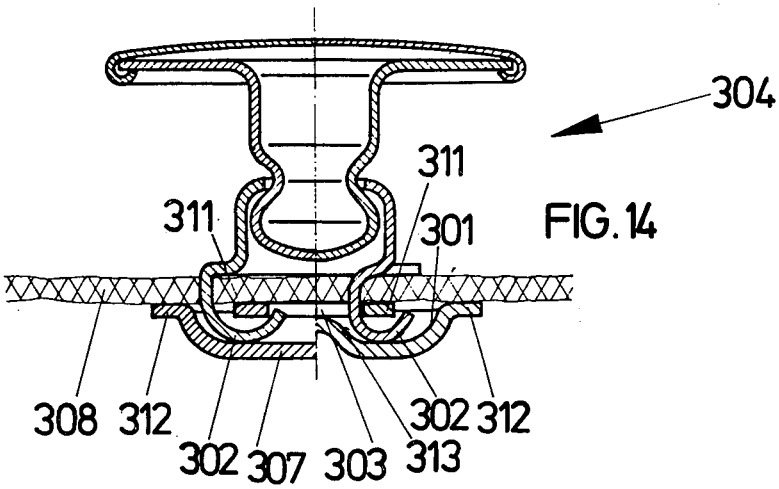
FIG. 14 is a cross-sectional elevational view of a sixth embodiment of the button having a concealed plate coordination showing varied two use forms, and illustrated in secured condition.
Figure 15:
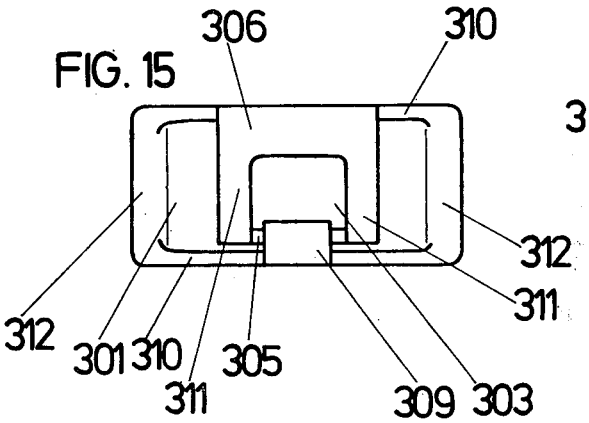
FIG. 15 is a plan view of the concealed plate of FIG. 14.
Figure 16:
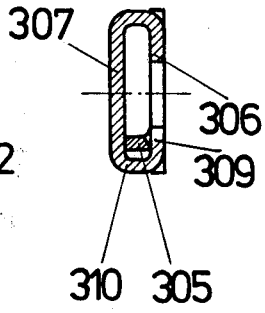
FIG. 16 is a lateral central cross-section through the concealed plate of FIG. 15.
Figure 17:
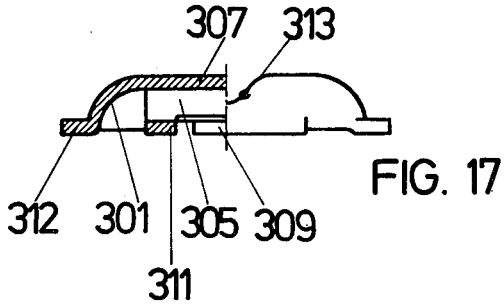
FIG. 17 is a reversed view of the cover plate of FIG. 14, half in section and half in elevation.

In accordance with a fourth embodiment of the invention (FIG. 5), the tilting pin 3 which originates from the button plate 1 has a ball head 22 on its free end, the ball head snapping-in the insert opening 4 of the foot part 2. The pin 3, and the mouth section opening into the snap-catch recess 4 of the foot part 2, are so dimensioned that also here the tilting or pivotal positions of the button plate 1, as indicated in dashed-dotted lines in FIG. 1, are attained.

The foot part 2, produced in the present embodiment of synthetic material, extends in a central pin or spike 23. The latter pierces through the carrier material 7 and enters a breakthrough opening 24 of a counter holding plate 25. The breakthrough opening 24 continues into a recess 26 having a larger diameter. The latter forms a retaining shoulder 27 for the pin 23, the pin being deformable by heat in an advantageous way by the use of thermoplastic synthetic material.

The button in accordance with the invention as shown in FIGS. 6–13, also essentially comprises a button plate 201, a foot part 202 and a concealed plate 209. The button plate 201 is formed cap-shaped and has a lower sided turned back edge 201′, which leaves free, i.e., defines, a central opening 203. This central opening 203 serves for the fastening of a pin 204 which is directed downwardly again centrally relative to the button plate, while the upper outwardly directed edge zone 204′ thereof engages behind the turned back edge 201′ of the button plate 201.

The pin 204 is formed as a hollow pin and possesses an annular groove 205 substantially in the center section of the pin. The pin 204 extends into a substantially ball shaped section 207, the lower front surface 206 of which is formed as a hemispherical calotte.

The operative connection of the button plate 201 with the foot part 202 is brought about by means of the pin 204, by the lower sided ball-shaped section 207 of the pin being pressed-through into the pot-interior space of the foot part 202, through an uppermost opening 208 of the pot-shaped foot part 202.

The largest cross-section of the ball shaped section 207 is thereby greater than the diameter of the penetration or insert opening 208 of the foot part, so that the pressing-in of the pin 204 in the foot part 202 occurs as a type of elastic clip or snap connection. After the pin is pressed in, the edge of the penetration opening 208 of the foot part 202 can additionally be bent in for a yet stable axial securing of the pin. In the pressed-in position of the pin, the annular groove 205 lies at the level of the opening edge of the opening 208 of the foot part. The button plate 201 is thus moveable axially relative to the pin axis as well as freely tiltable on all sides to a certain degree.

In order to coordinate the button to the carrier material, for example, a clothing piece, it is fixed by the aid of a concealed plate 209 serving as a counter holder means. The inner, that is, the material-sided location thereof is designated with the reference character 209′ and can be formed of two stays originating from the edge of the concealed plate which are bent toward each other. The pot-shaped foot part 202 has downwardly directed projecting securing claws 210, which by passing through the carrier material 211 penetrate in correspondingly arranged penetration openings 212 of the concealed plate floor 209′ and meet on the deflection channels 213 which turn around the free ends 210′ of the securing claws 210 so that they grip back the inner location 209′. In this way the foot part 202 of the button and the concealed plate 209 are braced against each other, with intermediate positioning of the carrier material 211, whereby the lower edge 202′ (FIG. 8) of the foot part 202 is bent for a large surface support on the carrier material.

After this anchoring of the button on the carrier material, the zone of the ball-formed section 207, which lies adjacent the groove 205 is supported on the complementary, slight ball-shaped or arcuate running inside edge portion of the upper sided pot-opening edge 208' on one side and on the other side with the calotte shaped front surface 206 on the elastically pressable carrier material 211.

In spite of the free moveability of the button plate 201, thus there is obtained a certain position fixing of the tilting pin 204 of the type such that the button can not freely swing or tilt downwardly due to its weight.

The different embodiment shown in FIGS. 11–13 of the concealed plate 220 has one continuous traversing stay forming the inner location 221, which stay is correspondingly bent out from one cross edge 222, and has an opening 223 in the center range. The free end 225 of this stay is bent off in the direction of the cap portion 220 of the concealed plate 220, which cap 220' forms the outer location 220', the free end 225 constituting a support leg 225 which is supported with its front face on the outer location 220'. The penetration openings 224 for the bending claws remain open between one of the lateral side edges of the concealed plate 220 and the adjacent lateral edges of the stay 221, respectively.

The double-locationed (regioned) concealed plate formed from a blank according to the embodiment of FIGS. 14–17, likewise has radially formed channels 301 forming deflector or guide stabilizing surfaces, which during the mounting process causes the hook shaped formation of the securing claws 302.

The central opening 303 in the inner location 306 of the concealed plate leads to the formation of two retainer stays 311 and thus causes the securing claws 302 to be able to extend back in the carrier material 308 and by their hook form and the double passing-through of the carrier material 308 to provide the button part 304 with a secure hold on the carrier material 308.

An arch 313 in the center section of the concealed plate permits also locking elements to be mounted such that their securing claws 302 are inserted through the opening 303 of the location 306 of the counter plate and likewise are in hook-like shape formed outwardly.

The inner location 306 material-wise integrally originates from the side wall 310 of the outer location 307.

The support 305 is likewise material-wise integrally attached to the inner location 306 of the concealed plate; it is supported on the inner surface of the outer location 307.

A security strip 309, which likewise is material-wise integrally attached to the opposite side wall 310 of the concealed plate, overlaps gripping over the support 305 and can project in the opening 303.

The radial formed channels 301 and/or the side walls 310 can have flange-like formations 312.

In the embodiment of FIGS. 18–26, a concealed plate 409 is shown, the deflection channels 413 of which are bent such that they form in cross-section approximately closed rings.

The guide surfaces formed by the deflection channels 413 of the here circularly-formed concealed plate 409 are provided with stamped-out portions P which are radially directed to the center point, and which stabilize the cap-shape of the plate. The spacing remaining between the individual stampings form moreover guide channels K for the securing claws 410. As illustrated in FIGS. 23 and 24, the number of the guide channels can be varied by differently dimensioning of the stamp-outs; besides, here a material-removed stamp-out is illustrated of a type such that the free outer surface of the concealed plate is completely smooth and even.

FIG. 25 shows a securing claw 410 being inserted into a channel K just prior to the rolling of the securing claws.

FIG. 26 illustrates a pierced through stamping by which the ribs, which are also directed outwardly star-shaped, act as constructional elements of the concealed plate. According to FIGS. 18 and 19 the deflection channels 413 of the concealed plate are directed inwardly towards each other in a manner whereby the cross-section can be held small.

The outer edge 440 thereby lies slightly deeper than the bent back inner edge 441, the latter forming a rear cut for the rolled-in bending claws 410. In order to avoid cutting-in of the outer edge 440 into the carrier material, the edge 440 as illustrated in FIG. 18 is bent planarly outwardly, or as illustrated in FIG. 19 is completely bent back into a rounded-off engagement shoulder.

By the embodiments shown in FIGS. 20–22 of the concealed plate, the deflection channels 413 are formed outwardly in opposite directions so that the securing claws of the foot part 404 are rolled-in outwardly.

Also here the contact zones which are associated with the carrier material are formed correspondingly surface rounded in order to prevent a scratching or cutting therein. FIG. 21 shows the annularly concealed plate 409 having its inner edge bent back in an outward direction, whereas FIG. 22 shows a similarly formed embodiment with the inner edge bent back in an inward direction.

While we have disclosed several embodiments of the invention, it is to be understood that these embodiments are given by example only and not in a limiting sense.

We claim:

1. A button, particularly for clothing pieces including a carrier material in fastened condition, comprising a foot part having a wall formed in the shape of a vertically oriented open ended hollow member defining a hollow cavity therein, said foot part having a lower peripheral edge defining a lower opening communicating with said cavity and abutting an upper side of the carrier material and clamping claws integrally extending substantially flush from said wall and said lower peripheral edge and non-rotatably clamping said peripheral edge and the carrier material and piercing through the latter, a button plate operatively freely selectively tiltably seated on said foot part, a tilting pin secured to said button plate, said tilting pin having a bulge-shaped lower end, said foot part having an upper head end, the latter being formed with an insert opening communicating with said hollow cavity and freely tiltably mountably receiving said bulge-shaped lower end of said tilting pin therein, a counter holder plate abutting an underside of the carrier material, and having curved deflection channel means for turning said clamping claws around pointing upwardly in said counter holder plate in a direction toward said hollow cavity, said securing claws passing downwardly through said carrier material and engaging said counter holder plate in non-rotatable position relative to said carrier material, entering said deflection channel means thereby being turned upwardly, cooperatively clamping and pressing the carrier material against said peripheral edge of said foot part, whereby the carrier material partially extends archingly inside said lower hollow opening into said hollow cavity, and said bulge-shaped lower end of said tilting pin having a vertical length substantially equal to the height of said foot part from said upper head end to said lower peripheral edge and having a curved lower end surface aligned adjacent the level of said peripheral edge of said foot part and pivotal relative to said foot part, said lower end surface abutting the carrier material, thereby dampening noise and providing a friction brake action effect for said tilting pin.

2. The button, as in claim 1, wherein said foot part includes an edge which defines said insert opening, said tilting pin is formed with a pivot groove in the range of said edge.

3. The button, as in claim 1, wherein said curved lower end surface is formed calotte-shaped.

4. The button, as in claim 1, wherein said counter holder plate constitutes a concealed plate and comprises an inner location forming a floor surface facing the carrier material, said inner location consists of two stays bent toward each other and spaced from each other defining a central space therebetween, each of said stays defines a penetration opening through which said clamping claws, respectively, are inserted, the latter being secured in said concealed plate turned around and pointing upwardly between said central space.

5. The button, as in claim 1, wherein said wall is formed with a flat annular flange at a lower side thereof, said annular flange is bent in a radially outward direction relative to a vertical axis of said foot part.

6. The button, as in claim 1, wherein said foot part has an insert opening edge defining said insert opening, said tilting pin is formed as a hollow pin having an exterior suface defining an annular groove, said insert opening edge is inserted in said annular groove, said tilting pin includes an outwardly directed upper edge zone which carries said button plate thereon.

7. The button, as set forth in claim 1, wherein said upper head end of said foot part is formed with an arcuate inside edge portion supporting an upper portion of said bulge-shaped lower end of said tilting pin and said curved lower end surface of said tilting pin abuts the carrier material and is substantially at the same level as but no lower than the peripheral edge of said foot part whereby a secure clamping of said peripheral edge against the carrier material is attained.

8. The button, as set forth in claim 1, wherein said clamping claws have ends which are disposed spaced apart from said hollow cavity, said carrier material being pressed slightly into said hollow cavity.

* * * * *